US009099093B2

(12) United States Patent
Choi et al.

(10) Patent No.: US 9,099,093 B2
(45) Date of Patent: Aug. 4, 2015

(54) APPARATUS AND METHOD OF IMPROVING INTELLIGIBILITY OF VOICE SIGNAL

(75) Inventors: Chang-kyu Choi, Seongnam-si (KR); Kwang-il Hwang, Seoul (KR); Sun-gi Hong, Yongin-si (KR); Young-hun Sung, Hwaseong-si (KR); Yeun-bae Kim, Seongnam-si (KR); Yong Kim, Seongnam-si (KR); Sang-hoon Lee, Seongnam-si (KR); Hong Jeong, Seongnam-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 1611 days.

(21) Appl. No.: 11/984,421

(22) Filed: Nov. 16, 2007

(65) Prior Publication Data

US 2008/0167863 A1 Jul. 10, 2008

(30) Foreign Application Priority Data

Jan. 5, 2007 (KR) ..... 10-2007-0001598

(51) Int. Cl.

| | |
|---|---|
| ***G10L 21/00*** | (2013.01) |
| ***G10L 21/02*** | (2013.01) |
| ***G10L 25/93*** | (2013.01) |
| ***G10L 21/0208*** | (2013.01) |
| ***G10L 21/0364*** | (2013.01) |
| *G10L 25/78* | (2013.01) |
| *G10L 25/90* | (2013.01) |

(52) U.S. Cl.

CPC ..... *G10L 21/0208* (2013.01); *G10L 21/0364* (2013.01); *G10L 25/78* (2013.01); *G10L 25/90* (2013.01)

(58) Field of Classification Search

USPC ..... 704/208, 210, 228, 233

See application file for complete search history.

(56) References Cited

U.S. PATENT DOCUMENTS

| | | | | |
|---|---|---|---|---|
| 3,894,195 | A * | 7/1975 | Kryter | 381/23.1 |
| 4,630,304 | A * | 12/1986 | Borth et al. | 381/94.3 |
| 4,630,305 | A * | 12/1986 | Borth et al. | 381/94.3 |

(Continued)

FOREIGN PATENT DOCUMENTS

| | | |
|---|---|---|
| JP | 2000-22568 | 1/2000 |
| JP | 2005-203981 | 7/2005 |

(Continued)

OTHER PUBLICATIONS

Atal, B. et al., "A Pattern Recognition Approach to Voice-Unvoiced-Silence Classification with Applications to Speech Recognition," IEEE Transactions on Acoustics, Speech, and Signal Processing, vol. ASSP-24, No. 3, Jun. 1976, pp. 201-212.

(Continued)

*Primary Examiner* — Olujimi Adesanya

(74) *Attorney, Agent, or Firm* — Harness, Dickey & Pierce, P.L.C.

(57) ABSTRACT

The present invention relates to an apparatus and method of improving intelligibility of a voice signal. A method of improving intelligibility of a voice signal according to an embodiment of the present invention includes analyzing a background noise signal on a call receiving side, classifying a received voice signal into a silence signal, an unvoiced sound signal, and a voiced sound signal, and intensifying the classified unvoiced sound signal and voiced sound signal on the basis of the analyzed background noise signal on the call receiving side.

14 Claims, 8 Drawing Sheets

(56) References Cited

U.S. PATENT DOCUMENTS

| | | | | |
|---|---|---|---|---|
| 5,305,420 | A * | 4/1994 | Nakamura et al. | 704/271 |
| 5,867,815 | A * | 2/1999 | Kondo et al. | 704/228 |
| 6,289,309 | B1 * | 9/2001 | deVries | 704/233 |
| 6,591,234 | B1 * | 7/2003 | Chandran et al. | 704/225 |
| 6,691,090 | B1 * | 2/2004 | Laurila et al. | 704/250 |
| 7,065,485 | B1 * | 6/2006 | Chong-White et al. | 704/208 |
| 7,492,889 | B2 * | 2/2009 | Ebenezer | 379/392.01 |
| 7,649,988 | B2 * | 1/2010 | Suppappola et al. | 379/406.03 |
| 7,716,046 | B2 * | 5/2010 | Nongpiur et al. | 704/226 |
| 8,484,035 | B2 * | 7/2013 | Pentland | 704/278 |
| 2003/0050786 | A1 * | 3/2003 | Jax et al. | 704/500 |
| 2005/0108008 | A1 * | 5/2005 | Macours | 704/225 |
| 2005/0177363 | A1 * | 8/2005 | Oh | 704/208 |
| 2005/0227657 | A1 * | 10/2005 | Frankkila et al. | 455/255 |
| 2005/0240401 | A1 * | 10/2005 | Ebenezer | 704/226 |
| 2005/0278171 | A1 * | 12/2005 | Suppappola et al. | 704/227 |
| 2006/0015331 | A1 * | 1/2006 | Hui et al. | 704/227 |
| 2006/0200344 | A1 * | 9/2006 | Kosek et al. | 704/226 |
| 2006/0241938 | A1 * | 10/2006 | Hetherington et al. | 704/208 |
| 2007/0038440 | A1 * | 2/2007 | Sung et al. | 704/218 |
| 2007/0088546 | A1 * | 4/2007 | Song et al. | 704/233 |

FOREIGN PATENT DOCUMENTS

| | | |
|---|---|---|
| KR | 10-1999-0044659 | 6/1999 |
| KR | 10-2001-0014352 | 2/2001 |
| KR | 10-2006-0122854 | 11/2006 |

OTHER PUBLICATIONS

Korean Office Action issued Mar. 29, 2013 in corresponding Korean Patent Application No. 10-2007-0001598.

Yoon-Chang Lee et al., "Improved Speech Enhancement Algorithm employing Multi-band Power Subtraction and Wavelet Packets Decomposition", Multi-band Power Subtraction, Wavelet Packets Decomposition, 2006, vol. 31, No. 6C, pp. 589-602.

* cited by examiner

APPARATUS AND METHOD OF IMPROVING INTELLIGIBILITY OF VOICE SIGNAL

CROSS REFERENCE TO RELATED APPLICATION

This application claims priority from Korean Patent Application No. 10-2007-0001598 filed on Jan. 5, 2007 in the Korean Intellectual Property Office, the disclosure of which is incorporated herein by reference in its entirety.

BACKGROUND OF THE INVENTION

1. Field of the Invention

The present invention relates to an apparatus for improving intelligibility of a voice signal, and in particular, to a method and apparatus that can easily recognize a voice of another user by improving intelligibility of a voice signal, even if a user receives a voice signal under a loud noise environment.

2. Description of the Related Art

Usually, in order to improve intelligibility of a voice signal, the voice signal is separated from a noise signal or voice signal power is increased in a state where voice is mixed with noise.

The above-described procedures are mostly performed on a call transmitting side. When a call receiving side is under a loud noise environment, the intelligibility of the voice signal is degraded. Accordingly, it is difficult for the call receiving side to recognize a voice of the call transmitting side. This is because the call receiving side directly hears peripheral noise, and the call receiving side cannot perform an additional signal processing with respect to noise.

Therefore, it is necessary to improve the intelligibility of the voice signal on the call receiving side under the loud noise environment.

SUMMARY OF THE INVENTION

An object of the present invention is to provide an apparatus and method that can improve intelligibility of a voice signal by analyzing noise around a call receiving side in real time and processing a voice on the basis of the analysis result.

Objects of the present invention are not limited to those mentioned above, and other objects of the present invention will be apparently understood by those skilled in the art through the following description.

According to an aspect of the present invention, there is provided an apparatus for improving intelligibility of a voice signal, the apparatus including a measurement unit receiving and analyzing a background noise signal on a call receiving side, a voice signal conversion unit classifying a received voice signal into a silence signal, an unvoiced sound signal, and a voiced sound signal and intensifying the received voice signal on the basis of the classification result and the analysis result, and a speaker outputting the intensified voice signal.

According to another aspect of the present invention, there is provided an apparatus for improving intelligibility of a voice signal, the apparatus including a voice signal separation module separating a received voice signal into a silence signal, a voiced sound signal, and an unvoiced sound signal, a band power adjustment module adjusting band power for every band of the received voice signal on the basis of band power for every band of a received noise signal when the received voice signal is the voiced sound signal, and a first frame power adjustment module adjusting frame power of a voice signal amplified by the band power adjustment module on the basis of frame power of the noise signal.

According to still another aspect of the present invention, there is provided a method of improving intelligibility of a voice signal, the method including analyzing a voice signal and a background noise signal to be received, classifying the received voice signal into a silence signal, an unvoiced sound signal, and a voiced sound signal, and intensifying the classified unvoiced sound signal and voiced sound signal on the basis of the analyzed noise signal.

According to yet still another aspect of the present invention, there is provided a method of improving intelligibility of a voice signal, the method including separating a received voice signal into a silence signal, a voiced sound signal, and an unvoiced sound signal, adjusting band power for every band of the received voice signal on the basis of band power for every band of a received noise signal when the received voice signal is the voiced sound signal, and adjusting frame power of a voice signal amplified in the adjusting of the band power on the basis of frame power of the noise signal.

BRIEF DESCRIPTION OF THE DRAWINGS

The above and other features and advantages of the present invention will become more apparent by describing in detail preferred embodiments thereof with reference to the attached drawings in which.

DESCRIPTION OF THE PREFERRED EMBODIMENTS

Figure 1:
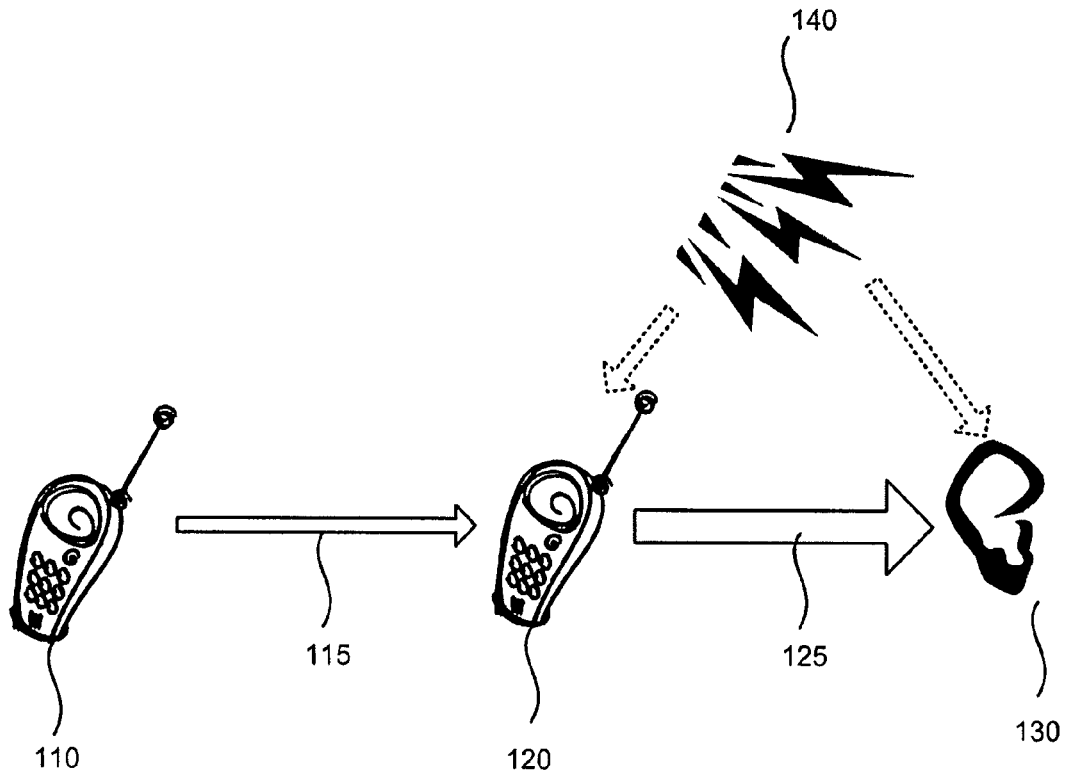
FIG. 1 is a diagram showing the basic concept according to an embodiment of the present invention.

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the present invention to those skilled in the art, and the present invention will only be defined by the appended claims.

Hereinafter, an apparatus and a method of improving intelligibility of a voice signal according to an embodiment of the present invention is described hereinafter with reference to block diagrams and flowchart illustrations. It will be understood that each block of the flowchart illustrations, and combinations of blocks in the flowchart illustrations, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions specified in the flowchart block or blocks. These computer program instructions may also be stored in a computer usable or computer-readable memory that can direct a computer or other programmable data processing apparatus to function in a particular manner, such that the instructions stored in the computer usable or computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart block or blocks.

Further, each block of the flowchart illustrations may represent a module, segment, or portion of code, which comprises one or more executable instructions for implementing the specified logical function(s). It should also be noted that in some alternative implementations, the functions noted in the blocks may occur out of the order. For example, two blocks shown in succession may in fact be executed substantially concurrently or the blocks may sometimes be executed in the reverse order, depending upon the functionality involved.

According to an embodiment of the present invention, in expectation that a voice signal and a noise signal are not mixed from the beginning but the noise signal is mixed with the voice signal subsequently, the voice signal is processed to be not vulnerable to the noise signal.

It is assumed that, in case of a call using a portable terminal, when a voice of a call transmitting side is transmitted to a call receiving side without noise, the call receiving side is under a loud noise environment. According to the embodiment of the present invention, there is provided a method that can improve intelligibility of a voice signal by analyzing peripheral noise in real time and processing the voice signal to be not vulnerable to noise. This method is as shown in FIG. 1.

Referring to FIG. 1, a voice signal 115 is transmitted to a call receiving portable terminal 120 from a call transmitting portable terminal 110. At this time, if it is assumed that the peripheral environment around the call receiving side is very silent, the voice signal 115 transmitted from the call transmitting portable terminal 110 is a clean voice that is not mixed with noise. A voice from a speaker on a call transmitting side is transmitted to the call receiving portable terminal 120 and is recognized by a listener 130 on a call receiving side. The present invention is applied to a case where the listener on the call receiving side is under an environment of loud noise 140 and thus he/she cannot recognize the voice of the speaker.

To this end, in this embodiment, peripheral noise 140 is received in real time using a microphone of the call receiving portable terminal 120. Then, received noise 140 is analyzed through comparison with the voice signal 115. The voice signal 115 is processed in advance to be not vulnerable to noise in expectation that the voice signal 115 will be mixed with noise 140. Therefore, a voice signal 125 having improved intelligibility is recognized by the listener 130.

Figure 2:
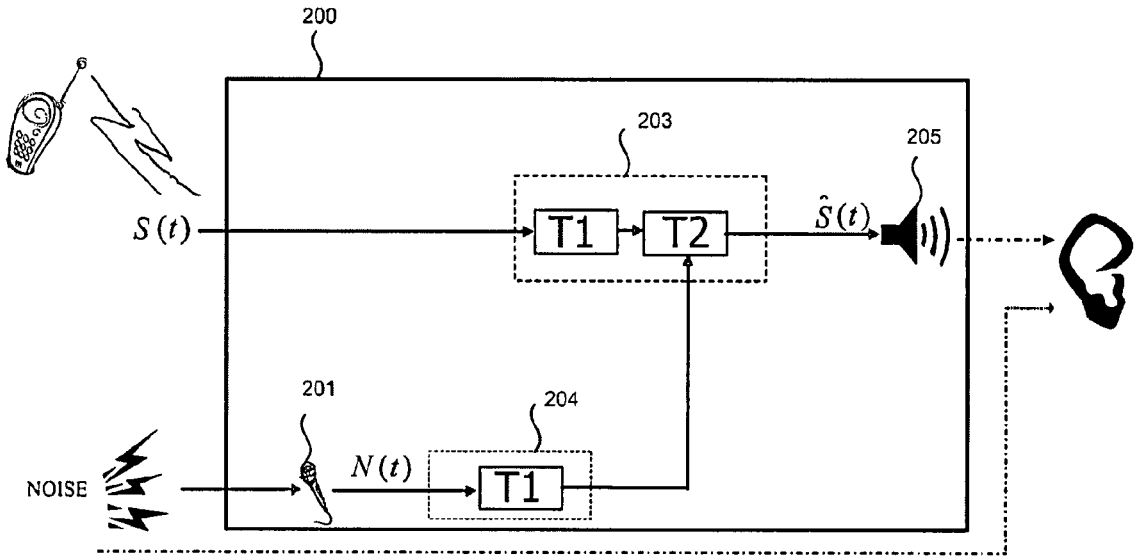
FIG. 2 is a diagram showing the schematic structure of an apparatus for improving intelligibility of a voice signal according to an embodiment of the present invention.

FIG. 2 is a diagram showing the schematic structure of an apparatus for improving intelligibility of a voice signal according to an embodiment of the present invention.

Referring to FIG. 2, the apparatus 200 for improving intelligibility of a voice signal includes a voice signal conversion unit 203 that converts the received voice signal S(t) into a voice signal $\hat{S}(t)$ having improved intelligibility, a speaker 205 that supplies the voice signal $\hat{S}(t)$ having improved intelligibility, a microphone 201 that receives a peripheral noise signal, and a measurement unit 204 that measures the received noise signal.

A block indicated by reference symbol "T1" represents a block in which a voice signal or a noise signal in a time region is converted into a voice signal or a noise signal in a frequency region. A block indicated by reference symbol "T2" represents a block in which the received voice signal S(t) is intensified to the voice signal $\hat{S}(t)$ having improved intelligibility on the basis of the analyzed noise signal.

The voice signal conversion unit 203 classifies the input voice signal into a silence signal, an unvoiced sound signal, and a voiced sound signal, and intensifies the input voice signal using the classification result and energy information according to the noise bands.

The measurement unit 204 converts the noise signal in the time region into the noise signal in the frequency region using the T1 block, separates noise energy according to the bands, and supplies energy information according to the bands to the voice signal conversion unit 203.

Figure 3:
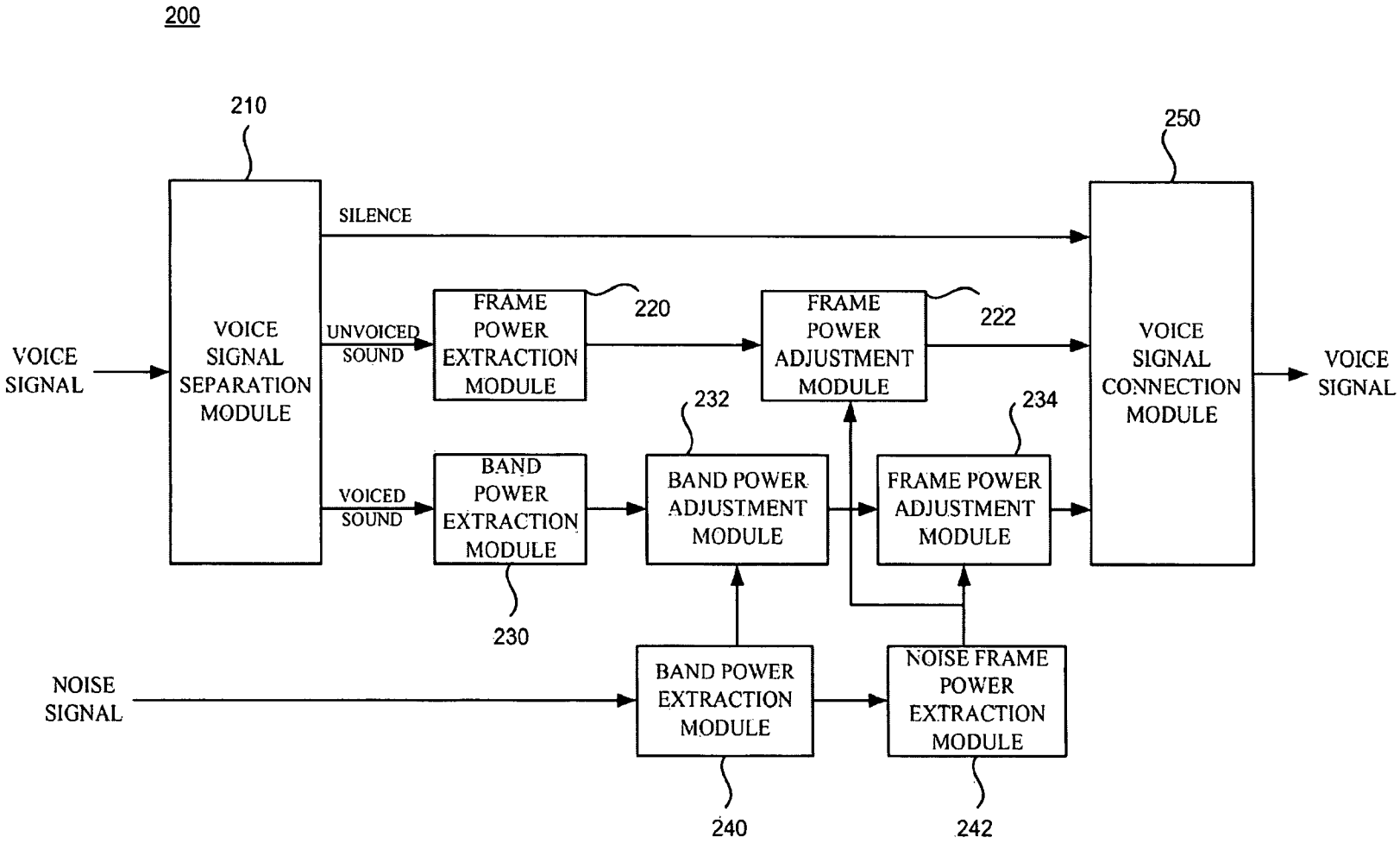
FIG. 3 is a diagram showing the detailed structure of an apparatus for improving intelligibility of a voice signal according to an embodiment of the present invention.

FIG. 3 is a diagram showing the detailed structure of an apparatus for improving intelligibility of a voice signal according to an embodiment of the present invention.

Referring to FIG. 3, an apparatus 200 for improving intelligibility of a voice signal includes a voice signal separation module 210, a frame power extraction module 220, a frame power adjustment module 222, a band power extraction module 230, a band power adjustment module 232, a frame power adjustment module 234, a noise band power extraction module 240, a noise frame power extraction module 242, and a voice signal connection module 250.

The voice signal separation module 210 separates the received voice signal into a silence signal, an unvoiced sound signal, and a voiced sound signal.

The frame power extraction module 220 extracts power of voice frames that are divided at a predetermined time interval.

The frame power adjustment module 222 adjusts the power of the extracted voice frames on the basis of frame power of noise.

The band power extraction module 230 extracts band power of a voice, and the band power adjustment module 232 adjusts the extracted band power on the basis of the band power of noise. The frame power adjustment module 234 adjusts the adjusted band power of the voice on the basis of the frame power of noise.

The noise band power extraction module 240 extracts band power from the input noise signal, and the noise frame power extraction module 242 extracts frame power of noise.

The voice signal connection module 250 combines the voice that has been separated into the silence signal, the unvoiced sound signal, and the voiced sound signal and outputs a voice signal having improved intelligibility.

Hereinafter, the operations between the modules shown in FIG. 3 will be described in detail.

First, the voice signal is subjected to a window process and is then input to the voice signal separation module 210. The window process is generally used in a field of a voice signal processing and means a process of dividing the received voice signal into frames at a predetermined time interval. For example, the window process may be performed such that the size of each of the frames is set to 32 ms and the frames overlap every 16 ms.

If the voice signal is input to the voice signal separation module 210 in frames, the input voice signal is separated into the silence signal, the unvoiced sound signal, and the voiced sound signal. This is to separately process the silence signal, the unvoiced sound signal, and the voiced sound signal since noise differently affects on the silence signal, the unvoiced sound signal, and the voiced sound signal. Thereafter, the silence signal, the unvoiced sound signal, and the voiced sound signal are combined by the voice signal connection module 250.

Figure 4A:
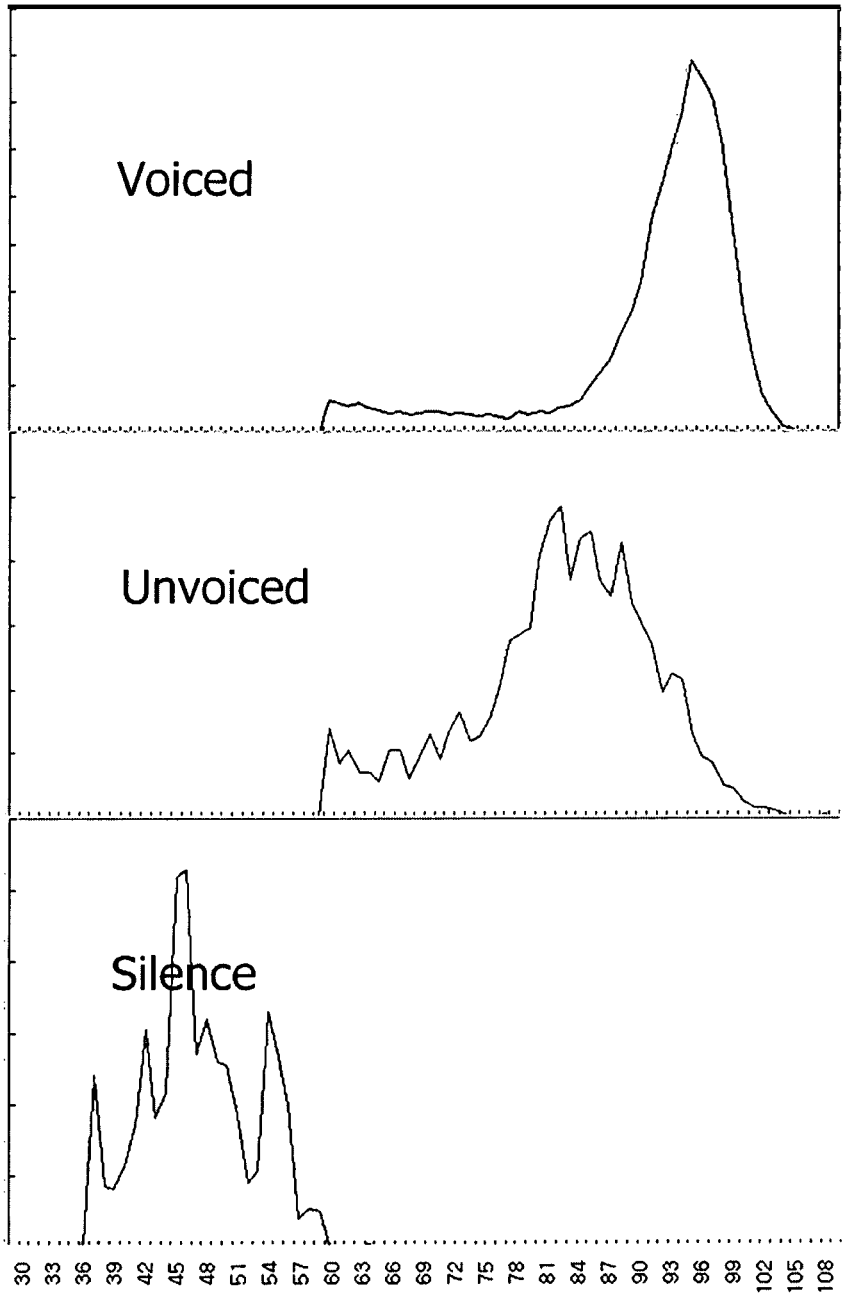
FIGS. 4A to 4C are graphs illustrating characteristics of a voiced sound signal, an unvoiced sound signal, and a silence signal through comparison.
Figure 4B:
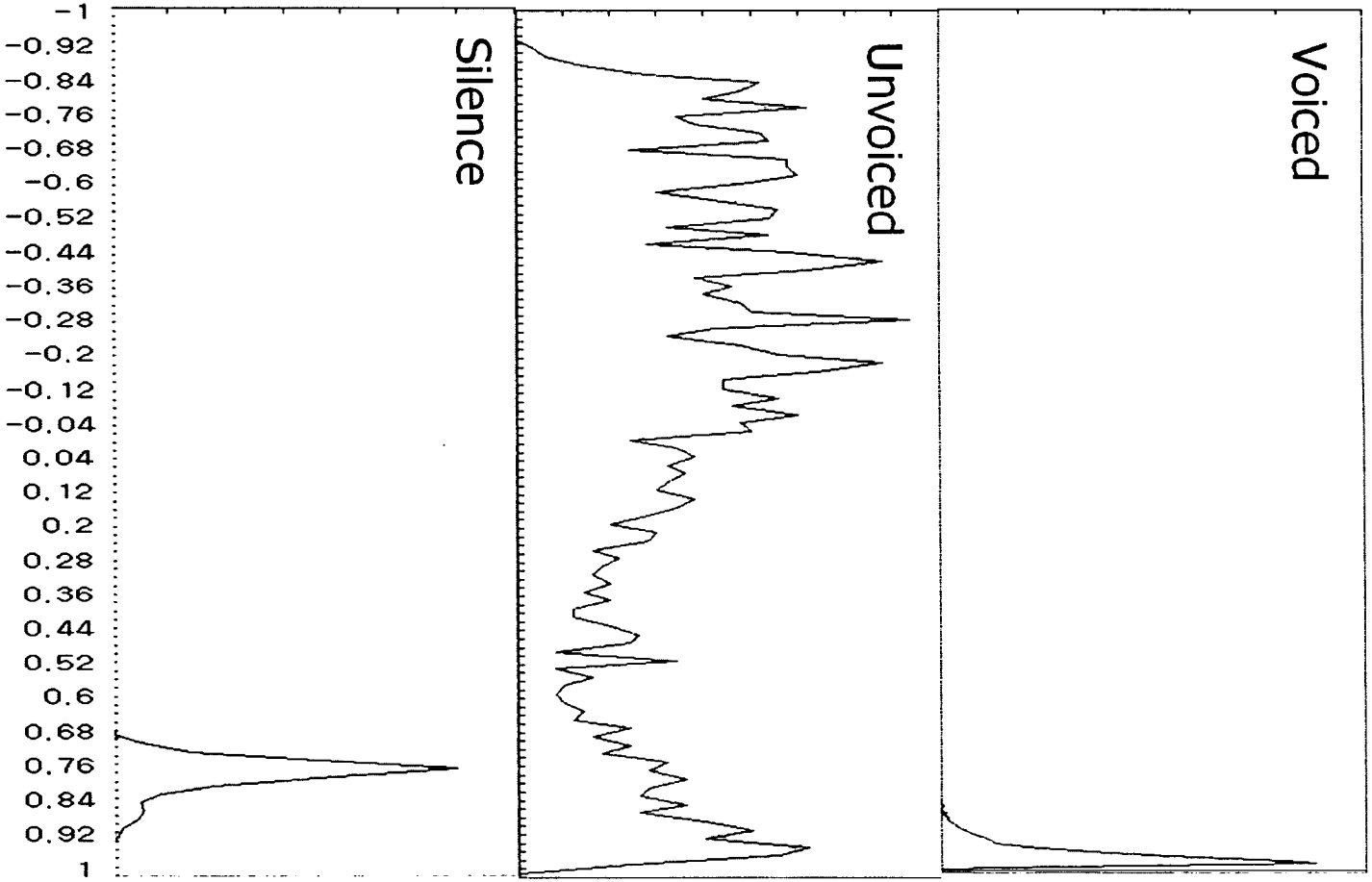
Figure 4C:
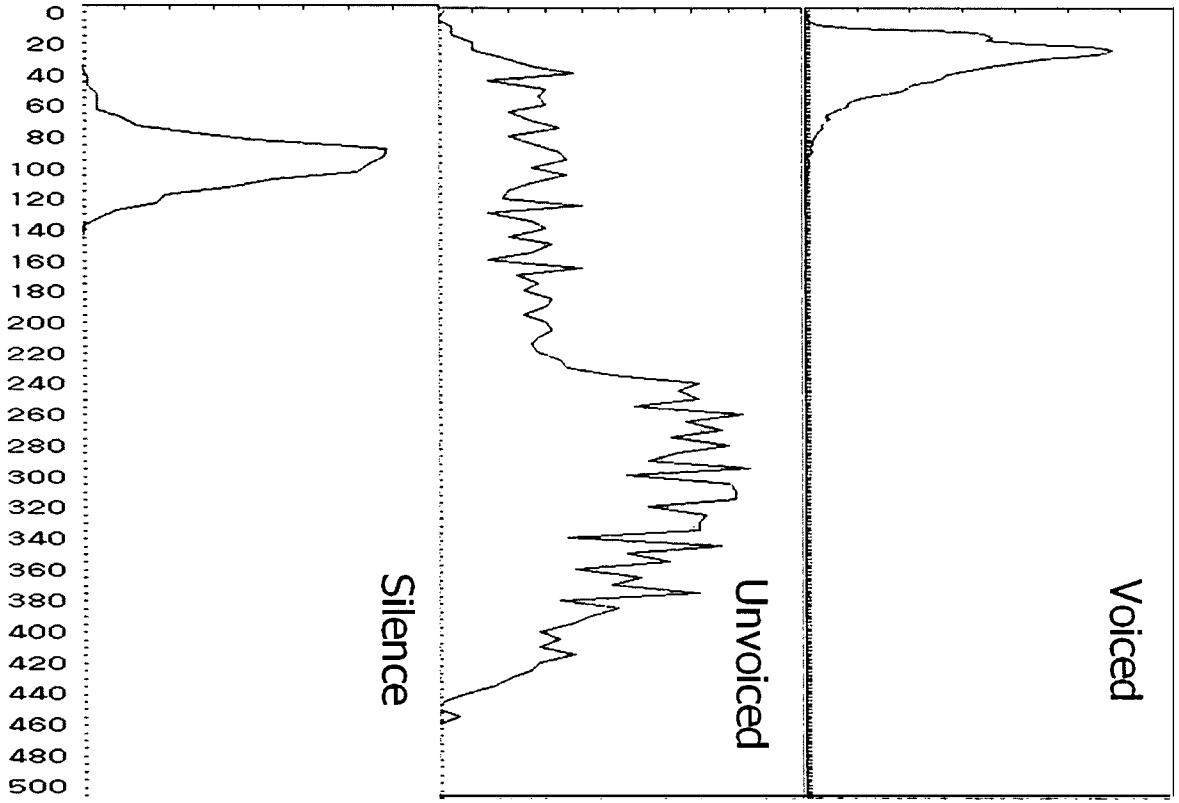

In order to separate the voice signal into the silence signal, the unvoiced sound signal, and the voiced sound, three characteristics, such as energy, an autocorrelation coefficient, and a zero-crossing rate of a signal have been used. FIG. 4A is a graph showing the energy characteristic of the signal. FIG. 4B is a graph showing the autocorrelation coefficient characteristic of the signal. FIG. 4C is a graph showing the zero-crossing rate characteristic of the signal.

Meanwhile, energy of the signal may be represented by Equation 1 and the autocorrelation coefficient of the signal may be represented by Equation 2.

$$E_s = 10 \times \log_{10}\left(\varepsilon + \frac{1}{N}\sum_{n=1}^{N} s^2(n)\right) \quad \text{Equation 1}$$

$$C_1 = \frac{\sum_{n=1}^{N} s(n)s(n-1)}{\sqrt{\left(\sum_{n=1}^{n} s^2(n)\right)\left(\sum_{n=0}^{N-1} S^2(n)\right)}} \quad \text{Equation 2}$$

Reference symbol s(n) in Equations 1 and 2 represents a sampled and digitalized voice signal, and reference symbol N represents the size of the frame.

Referring to FIG. 4A, the silence signal has a smallest energy value, and the unvoiced sound signal and the voiced sound signal have larger energy values increasing in that order.

Referring to FIG. 4B, the unvoiced sound signal has the smallest autocorrelation coefficient and the silence and voiced sound signals have larger autocorrelation coefficients increasing in that order.

Referring to FIG. 4C, the voiced sound signal has the smallest zero-crossing rate and the silence and unvoiced sound signals have larger zero-crossing rates increasing in that order.

In order to use the above-described characteristic, a database, in which the voiced sound signal, the unvoiced sound signal, and the silence signal are classified, is used to study a method of finding the averages of the energy, the zero-crossing rates, and the autocorrelation coefficients and a covariance matrix according to the classifications.

Therefore, the current voice signal are separated into three parts (silence, voiced sound, and unvoiced sound) using the study result and the three characteristics (energy, autocorrelation coefficient, and zero-crossing rate) of the voice signal transmitted from the call transmitting side.

A method of separating an input voice into silence, unvoiced sound, and voiced sound signals is described in a paper by Bishnu S. Atal, and Lawrence R. Rabiner, titled "A Pattern Recognition Approach to Voiced-Unvoiced-Silence Classification with Applications to Speech Recognition", IEEE Transactions on Acoustics, Speech, and Signal Processing, vol. ASSP-24, no. 3, June 1976. Further, any known method of separating an input voice into silence, unvoiced sound, and voiced sound signals may be applied to the present invention.

The silence signal of the voice indicates a case where the speaker on the call transmitting side does not speak. In this case, no process is necessary.

Figure 5:
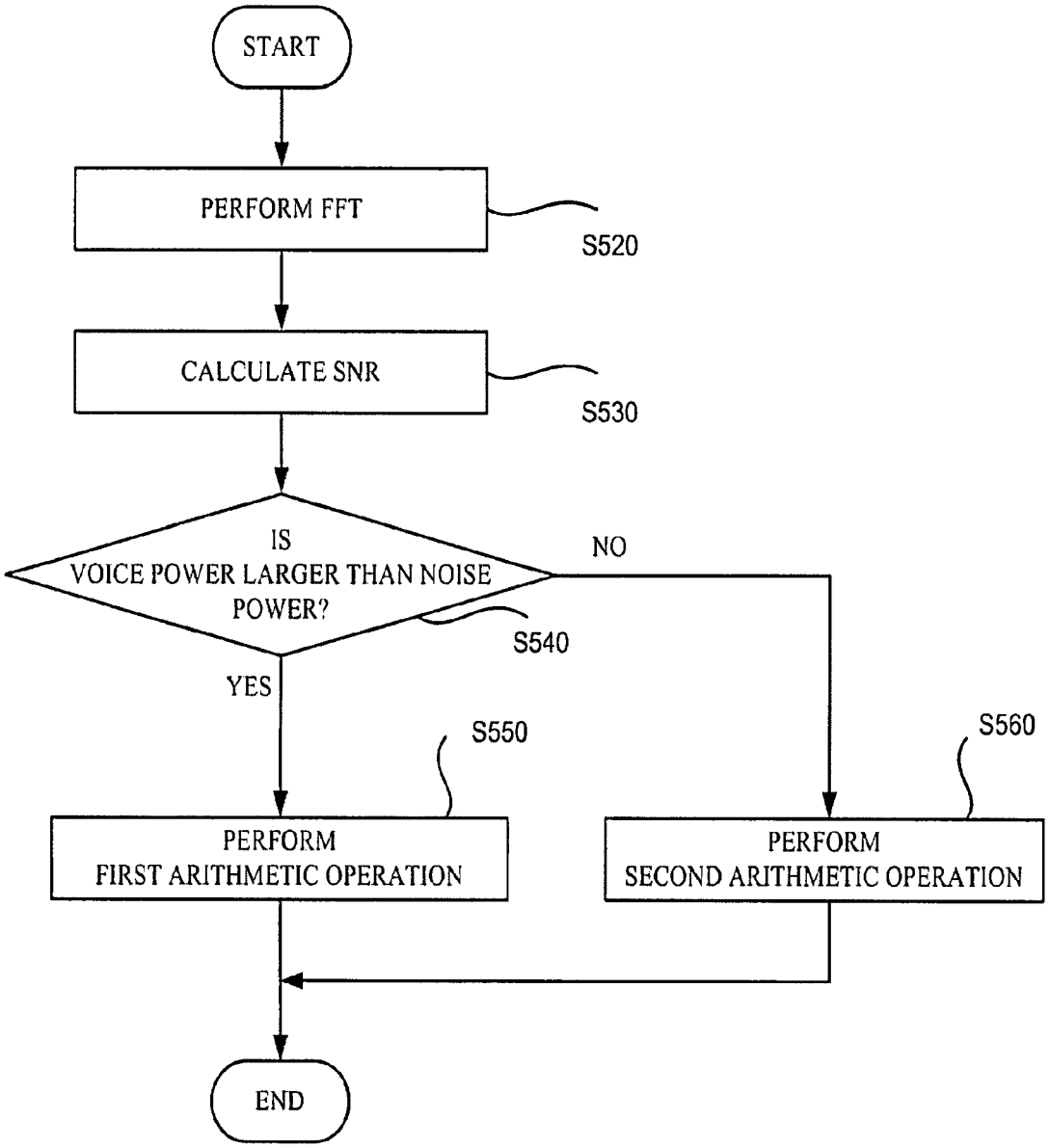
FIG. 5 is a flowchart showing a method of intensifying an unvoiced sound signal according to an embodiment of the present invention.

The unvoiced sound signal of the voice is processed as shown in a flowchart of FIG. 5. The voiced sound signal of the voice is processed as shown in a flowchart of FIG. 6.

First, referring to FIGS. 3 and 5, the frame power extraction module 220 performs a fast Fourier transform (hereinafter, referred to as "FFT") with respect to the seperated unvoiced sound voice signal (Step S520).

For example, if the voice signal before the FFT is performed is represented by Equation 3, the voice signal after the FFT is performed may be represented by Equation 4.

$$s(t)=\{s(0),s(1),\ldots,s(L-1)\}=\{s(l)\}_{l=0}^{L-1} \quad \text{Equation 3}$$

$$s(f)=\{s(0),s(1),\ldots,s(M-1)\}=\{s(m)\}_{m=1}^{M-1} \quad \text{Equation 4}$$

At this time, in Equations 3 and 4, L becomes 2M. This is because the signal in the converted frequency region is represented by a symmetrical signal in a complex conjugate relationship, and therefore, in a signal processing field, L signals are not used but only L/2(=M) voice signals are used. Further, a signal having an index of 0 among M signals is a DC component and is not used for the signal processing. Therefore, the actual number of signals used in the frequency region becomes M−1 for every frame.

For example, when the frame size is 32 ms and a sampling frequency of 16 kHz is used, the FFT of 512 points is performed. Therefore, L becomes 512 and M becomes 216. Further, the actual number of signals used in the frequency region becomes 215 in case of the frame size of 32 ms.

Thereafter, the frame power adjustment module 222 calculates a signal to noise ratio (hereinafter, referred to as "SNR"). The SNR may be represented by Equation 5 (Step S530).

$$\text{SNR}=P_S/P_N \quad \text{Equation 5}$$

Here, the definitions $$P_S = \sum_{m=1}^{M-1} S^2(m) \text{ and } P_n = \sum_{m=1}^{M-1} n^2(m)$$

are established. Reference symbol $P_s$ denotes voice signal power and reference symbol $P_n$ denotes noise signal power. The voice signal power $P_s$ may be calculated and supplied by the frame power extraction module, and the noise signal power $P_n$ may be supplied by the noise frame power extraction module 242 using the window process with respect to the noise signal or using the same method as that at Step S520.

At this time, the frame power adjustment module 222 compares the voice frame power and the noise frame power (Step S540). When the voice frame power is larger than the noise frame power, that is, when the SNR is larger than 1, a first arithmetic operation is performed so as to adjust the frame power (Step S550). Otherwise, a second arithmetic operation is performed (Step S560).

The first arithmetic operation and the second arithmetic operation are used to acquire a power gain that adjusts the frame power. When the power gain is G, the first arithmetic operation may be performed as Equation 6 and the second arithmetic operation may be performed as Equation 7.

$$G=1 \quad \text{Equation 6}$$

$$G=\sqrt{P_N} \quad \text{Equation 7}$$

The unvoiced sound signal that is intensified by the first arithmetic operation or the second arithmetic operation may be represented by Equation 8.

$$\hat{S}(f)=G\times S(f) \quad \text{Equation 8}$$

Referring to Equations 6 and 7, when the unvoiced sound signal exists in the current voice signal section, that is, a current frame, and power of the unvoiced sound signal is larger than power of peripheral noise on the call receiving side, it can be understood that the power of the unvoiced sound signal power is left unchanged. Otherwise, the power of the unvoiced sound signal is increased by the power of peripheral noise.

As described above, if the frame power adjustment module 222 adjusts the frame power using the first arithmetic operation or the second arithmetic operation, an intensified voice signal in the frequency region is generated and then converted into an intensified voice signal in the time region through a reverse FFT. The converted voice signal is supplied to the voice signal connection module 250.

Figure 6:
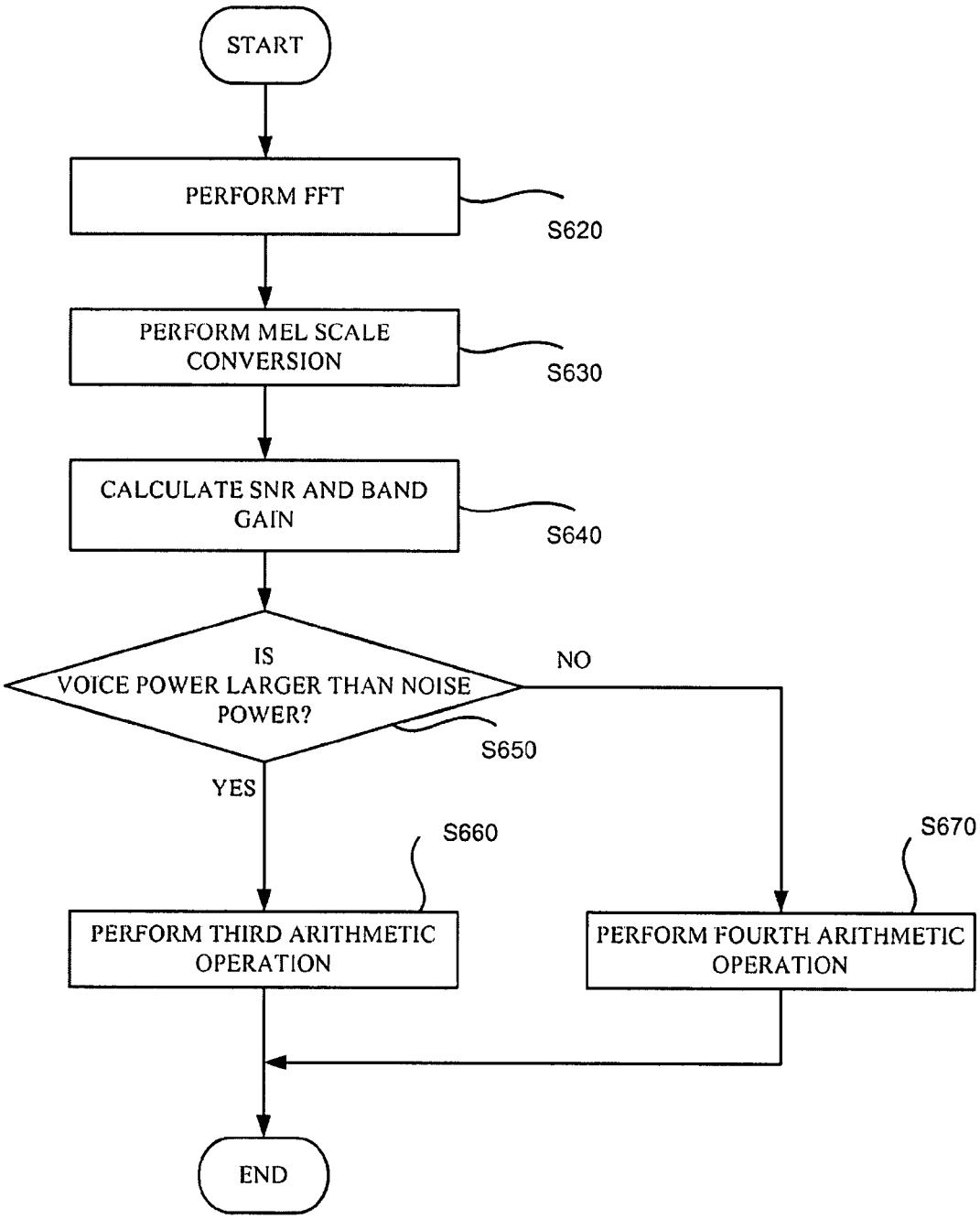
FIG. 6 is a flowchart showing a method of intensifying a voiced sound signal according to an embodiment of the present invention.

Meanwhile, the voiced sound signal of the voice signal is processed as shown in a flowchart of FIG. 6.

First, referring to FIGS. 3 and 6, the band power extraction module 230 performs the FFT with respect to the separated voiced sound signal (Step S620). The voice signal before the FFT is performed and the voice signal after the FFT is performed may be represented as Equations 3 and 4, respectively.

Thereafter, the voice signal in the frequency region through the FFT is classified into bands using the Mel scale algorithm (Step S630). For example, when the voice signal in the frequency region through the FFT has i frequency components, the i frequency components are divided into n bands (where n is equal to or smaller than i) by designating a first frequency component to a first band, a second frequency component to a second band, and third and fourth frequency components to a third band. That is, in this embodiment of the present invention, the band may be understood as a frequency group. In such a manner, the noise signal may have n bands.

Thereafter, the band power adjustment module 232 calculates the SNR and the band gain (Step S640). The SNR may be represented by Equation 5 and the band gain may be represented by Equation 9 according to the bands.

$$G(i) = \alpha + \beta \cdot SNR + \gamma \frac{\sum_{b\in B_i}^{N} n^2(b)}{\sum_{m=1}^{M-1} n^2(m)} \text{ where } i = 1, \ldots, I \quad \text{Equation 9}$$

Here, reference symbols α, β, and γ denote constants that are determined through the experiments. Reference symbol $B_i$ denotes a set of indexes b that indicate frequency components in an i-th band. According to this embodiment of the present invention, since the band is constructed on the basis of the Mel scale algorithm, the bands may have different sizes from one another. Further, the band power with respect to the noise signal may be supplied by the noise band power extraction module 240.

At this time, the band power adjustment module 232 amplifies the voice signal on the basis of the band gain for every band obtained using Equation 9. The frame power of the voice signal converted by the adjustment of the band gain for every band may be defined as Equation 10.

$$P'_s = \sum_{i-1}^{I} \sum_{m\in B_i} (G(i)\times S(m))^2 \quad \text{Equation 10}$$

The frame power adjustment module 234 compares the voice frame power and the noise frame power (Step S650) so as to process the amplified voice signal.

When the voice frame power is larger than the noise frame power, that is, when the SNR is larger than 1, a third arithmetic operation is performed so as to adjust the frame power (Step S660). Otherwise, a fourth arithmetic operation is performed (S670).

The third arithmetic operation and the fourth arithmetic operation are performed so as to acquire the power gain that adjusts the frame power. When the power gain is G', the third arithmetic operation may be performed as Equation 11 and the fourth arithmetic operation may be performed as Equation 12.

$$G(i)' = \frac{\sqrt{P_s}}{\sqrt{P'_s}} \times G(i) \quad \text{Equation 11}$$

$$G(i)' = \frac{\sqrt{P_n}}{\sqrt{P'_s}} \times G(i) \quad \text{Equation 12}$$

That is, if the power of the voice power is larger than the power of noise in the current frame, the gain G(i)' of Equation 11 is multiplied to the i-th band so as to keep an original voice power. Otherwise, the gain G(i)' of Equation 12 is multiplied to the i-th band.

In particular, if the power of noise is larger than the power of the voice, the voice may be masked by the noise signal. In order to avoid the masking phenomenon, the power of the voice signal should be increased. If the power of the voice signal is increased by the power of the noise signal, the masking phenomenon may be relieved.

Therefore, in order to increase the power of the voice signal by the power of the noise signal, if the gain G(i)' of Equation 12 is multiplied to the i-th band, it is possible to improve intelligibility of the voice under a noise environment.

The voiced sound signal that is intensified by the third arithmetic operation or the fourth arithmetic operation may be represented by Equation 13.

$$S(f)=G(i)'\times S(f) \quad \text{Equation 13}$$

As described above, if the frame power adjustment module 234 adjusts the frame power using the third arithmetic operation or the fourth arithmetic operation, the intensified voice signal in the frequency region is generated and converted into the intensified voice signal in the time region through the inverse FFT, and supplied to the voice signal connection module 250.

Meanwhile, in this embodiment of the present invention, the portable terminal has been exemplary described but the present invention is not limited thereto. The invention may be applied to various terminals or electronic products to which the voice signal is supplied. For example, the present invention may be applied to a television when a user is watching a news program through the television under a loud peripheral noise environment.

In the embodiment of the present invention, the term "module" represents software and hardware constituent elements such as a field programmable gate array (FPGA), or an application specific integrated circuit (ASIC). The module serves to perform some functions but is not limited to software or hardware. The unit may reside in an addressable memory. Alternatively, the unit may be provided to reproduce one or more processors. Therefore, examples of the module include elements such as software elements, object-oriented software elements, class elements, and task elements, processes, functions, attributes, procedures, subroutines, segments of program code, drivers, firmware, microcode, circuits, data, databases, data structures, tables, arrays, and parameters. The elements and the modules may be combined with other elements and modules or divided into additional elements and modules.

Although the present invention has been described in connection with the exemplary embodiments of the present invention, it will be apparent to those skilled in the art that various modifications and changes may be made thereto without departing from the scope and spirit of the present invention. Therefore, it should be understood that the above embodiments are not limitative, but illustrative in all aspects.

According to the embodiment of the present invention, even if a call receiving side is under a loud noise environment, it is possible to easily recognize a voice from a call transmitting side caller by improving intelligibility of a voice signal.

What is claimed is:

1. An apparatus for improving intelligibility of a voice signal, the apparatus comprising:

a measurement unit configured to analyze a background noise signal on a call receiving side;

a voice signal conversion unit configured to classify a received voice signal into a silence signal, an unvoiced sound signal, and a voiced sound signal and intensifying the received voice signal on the basis of the classification result and the analysis result with respect to the background noise signal; and a speaker configured to output the intensified voice signal, wherein classifying the received voice signal comprises performing a Fast Fourier Transform (FFT) with respect to the received voice signal and dividing the FFT signal into bands, intensifying the received voice signal comprises calculating a first signal to noise ratio (SNR) of the unvoiced sound signal power and the background noise signal power, calculating a second SNR of the voiced sound signal power and the background noise signal power, calculating each band gain in response to the bands in case of the voiced sound signal, increasing the power of the unvoiced sound signal on the basis of the background noise signal power if the first SNR is less than a first predetermined value, and increasing the power of the voiced sound signal on the basis of each band gain if the second SNR is less than a second predetermined value, and outputting an output voice signal output based on the silence signal, the intensified voiced sound signal, and the intensified unvoiced sound signal.

2. The apparatus of claim 1, wherein, when the received voice signal is the silence signal, the voice signal conversion unit directly transmits the received voice signal to the speaker.

3. The apparatus of claim 1, wherein, when the received voice signal is the unvoiced sound signal, the voice signal conversion unit intensifies the received voice signal using frame energy information of the received noise signal.

4. The apparatus of claim 1, wherein the voice signal conversion unit is configured to intensify the received voice signal using frame energy information of the received noise signal.

5. An apparatus for improving intelligibility of a voice signal, the apparatus comprising:

a voice signal separation module configured to separate a received voice signal into a silence signal, a voiced sound signal, and an unvoiced sound signal;

a band power adjustment module, when the received voice signal is the voiced sound signal, configured to adjust band power for every band of the received voice signal on the basis of band power for every band of a background noise signal on a call receiving side; and a first frame power adjustment module configured to adjust frame power of a voice signal amplified by the band power adjustment module on the basis of frame power of the background noise signal, wherein separating the received voice signal comprises performing a Fast Fourier Transform (FFT) with respect to the received voice signal and dividing the FFT signal into bands, adjusting the received voice signal power comprises calculating a first signal to noise ratio (SNR) of the unvoiced sound signal power and the background noise signal power, calculating a second SNR of the voiced sound signal power and the background noise signal power, calculating each band gain in response to the bands in case of the voiced sound signal, increasing the power of the unvoiced sound signal on the basis of the background noise signal power if the first SNR is less than a first predetermined value, and increasing the power of the voiced sound signal on the basis of each band gain if the second SNR is less than a second predetermined value, and outputting an output voice signal output based on the silence signal, the adjusted voiced sound signal, and the adjusted unvoiced sound signal.

6. The apparatus of claim 5, further comprising:

a second frame power adjustment module, when the received voice signal is the unvoiced sound signal, configured to adjust frame power of the received unvoiced sound signal on the basis of the frame power of the noise signal.

7. The apparatus of claim 5, further comprising:

a voice signal connection module configured to connect the separated voice signals.

8. A method of improving intelligibility of a voice signal, the method comprising:

analyzing a background noise signal on a call receiving side;

classifying a received voice signal into a silence signal, an unvoiced sound signal, and a voiced sound signal; and intensifying the classified unvoiced sound signal and voiced sound signal on the basis of the analyzed background noise signal on the call receiving side, wherein classifying the received voice signal comprises performing a Fast Fourier Transform (FFT) with respect to the received voice signal and dividing the FFT signal into bands, intensifying the classified signals comprises calculating a first signal to noise ratio (SNR) of the unvoiced sound signal power and the background noise signal power, calculating a second SNR of the voiced sound signal power and the background noise signal power, calculating each band gain in response to the bands in case of the voiced sound signal, increasing the power of the unvoiced sound signal on the basis of the background noise signal power if the first SNR is less than a first predetermined value, and increasing the power of the voiced sound signal on the basis of each band gain if the second SNR is less than a second predetermined value, and outputting an output voice signal output based on the silence signal, the intensified voiced sound signal, and the intensified unvoiced sound signal.

9. The method of claim 8, further comprising:

when the received voice signal is the silence signal, directly transmitting the received voice signal to the speaker.

10. The method of claim 8, wherein, when the received voice signal is the unvoiced sound signal, the intensifying of the unvoiced sound signal and the voiced sound signal comprises intensifying the received voice signal using frame energy information of the received noise signal.

11. The method of claim 8, wherein, when the received voice signal is the voiced sound signal, the intensifying of the unvoiced sound signal and the voiced sound signal comprises intensifying the received voice signal using frame energy information of the received noise signal.

12. A method of improving intelligibility of a voice signal, the method comprising:

separating a received voice signal into a silence signal, a voiced sound signal, and an unvoiced sound signal;

when the received voice signal is the voiced sound signal, adjusting band power for every band of the received voice signal on the basis of band power for every band of a received background noise signal on a call receiving side;

adjusting frame power of a voice signal amplified by the adjusting of the band power on the basis of frame power of the background noise signal, wherein separating the received voice signal comprises performing a Fast Fourier Transform (FFT) with respect to the received voice signal and dividing the FFT signal into bands, and adjusting the voice signal power comprises calculating a first signal to noise ratio (SNR) of the unvoiced sound signal power and the background noise signal power, calculating a second SNR of the voiced sound signal power and the background noise signal power, calculating each band gain in response to the bands in case of the voiced sound signal, increasing the power of the unvoiced sound signal on the basis of the background noise signal power if the first SNR is less than a first predetermined value, and increasing the power of the voiced sound signal on the basis of each band gain if the second SNR is less than a second predetermined value; and outputting an output voice signal output based on the silence signal, the adjusted voiced sound signal, and the adjusted unvoiced sound signal.

13. The method of claim 12, further comprising:

when the received voice signal is the unvoiced sound signal, adjusting frame power of the received unvoiced sound signal on the basis of the frame power of the noise signal.

14. The method of claim 12, further comprising:

connecting the separated voice signals.

* * * * *